US006512905B1

(12) United States Patent
Tomiki et al.

(10) Patent No.: US 6,512,905 B1
(45) Date of Patent: Jan. 28, 2003

(54) IMAGE FORMING APPARATUS CAPABLE OF ADJUSTING AC APPLIED TO CHARGING MEMBER

(75) Inventors: Satoshi Tomiki, Tokyo (JP); Takeo Yamamoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/464,075

(22) Filed: Dec. 16, 1999

(30) Foreign Application Priority Data

Dec. 22, 1998 (JP) ..... 10-364645

(51) Int. Cl.[7] ..... G03G 15/02; G03G 15/00

(52) U.S. Cl. ..... 399/115; 399/50; 399/11; 399/12; 399/81

(58) Field of Search ..... 399/24, 25, 45, 399/50, 111, 113, 115, 168, 170, 171, 172, 174, 175, 176, 11, 12, 81

(56) References Cited

U.S. PATENT DOCUMENTS 5,278,612 A * 1/1994 Inui ..... 399/115
5,812,902 A * 9/1998 Lee ..... 399/25
5,956,541 A * 9/1999 Hoshika et al. ..... 399/24
5,991,557 A 11/1999 Kunishi et al. ..... 399/45
6,118,952 A * 9/2000 Furuya ..... 399/50
6,229,970 B1 * 5/2001 Onimura et al. ..... 399/50

FOREIGN PATENT DOCUMENTS

| | | |
|---|---|---|
| EP | 0 782 050 | 2/1997 |
| JP | 64-50070 | 2/1989 |
| JP | 9-190143 | 7/1997 |

* cited by examiner

*Primary Examiner*—Hoang Ngo
(74) *Attorney, Agent, or Firm*—Fitzpatrick, Cella, Harper & Scinto

(57) ABSTRACT

An image forming apparatus with an image bearing member and a charging member for contactably charging the image bearing member. The charging member is provided within an exchangeable unit. An electric power containing an AC component is applied to the charging member, and adjustments are made to the magnitude of the AC component. When the exchangeable unit is exchanged, the magnitude of the AC component is returned to an initial value thereof, so as to extend the life of the image bearing member in situations where the exchangeable unit is exchanged and the AC component might otherwise have a magnitude inappropriate for the new unit.

10 Claims, 3 Drawing Sheets

IMAGE FORMING APPARATUS CAPABLE OF ADJUSTING AC APPLIED TO CHARGING MEMBER

BACKGROUND OF THE INVENTION

1. Field of the Invention

The present invention generally relates to an image forming apparatus such as a copying machine and a printer in which the electrophotographic system and the electrostatic recording system are used. More specifically, the present invention is directed to an image forming apparatus for applying an AC (alternating current) component to a charging member.

2. Related Background Art

Conventionally, corona discharge devices have been widely used as means for charging the surface of image bearing member functioning as a member to be charged (for instance, a photosensitive member and a dielectric member) employed in such image forming apparatuses known as electrophotographic apparatus and electrostatic recording apparatus, e.g., a copying machine and a photo-printer.

In contrast, contact charging devices in which a voltage-applied charging member is brought into contact with the surface of the member to be charged, for carrying out the charging process for the surface of the member to be charged, may have advantages in that power supplies thereof can be operated under low voltage, the ozone generation amount can be reduced, etc. As a consequence, such contact charging devices have attracted attention as novel charging process means, and have been already practically used. In particular, in view of the stable charging characteristic, roller charging type charging devices with employment of conductive rollers as the charging members are preferably used.

On the other hand, as for the methods for applying voltage to charge the charging member, there are exemplified the DC (direct current) roller charging method for applying only the DC voltage to charge the member to be charged, and the AC roller charging method for applying the DC voltage superimposed with the AC voltage to the charging member to conduct the charging process of the member to be charged. However, the AC roller charging method having the leveling (averaging) effect achieved by the AC electric field may have the superior uniform charging characteristic, thereby being preferably employed.

As for the bias applied to the charging member in this AC charging roller method, a selection is made of a DC constant voltage, a DC constant current, an AC constant voltage, and an AC constant current.

However, there are some possibilities that either the AC current values or the AC voltage values required to realize the uniform charging are made different from each other, depending upon various use environmental conditions and the surface characteristic degrees of the charging members. Specifically speaking, in the case where the use environmental condition is low humidity environment, and the surface characteristic (condition) of the charging member becomes better (namely, charging member owns superior surface smoothing characteristic), a large amount of AC currents, or AC voltages is required, as compared with the case where the conditions are different therefrom.

As a general trend, at an initial stage of a charging member, this charging member may have a superior surface characteristic, whereas this surface characteristic is gradually deteriorated because of wearing while image forming operation is repeatedly conducted. Therefore, when either an AC current or an AC voltage is determined under such a condition that this charging member may have the better surface characteristic at the initial stage, either the excessive AC voltage or the excessive AC current is applied to the charging member under the worse surface characteristic with respect to the necessary sufficient amounts. Such an application of either the excessive AC current or the excessive AC voltage may cause an increase of surface digging of a photosensitive member (namely, member to be charged), and thus may reduce the lifetime of this photosensitive member.

Conversely, when either the AC current or the AC voltage is determined in accordance with such a condition that the surface characteristic of the charging member is deteriorated, the uniform charging characteristic is deteriorated under such a condition that this charging member owns the better surface characteristic at the initial stage. For instance, there are some cases that black spots occur in a white background, or white spots occur in a black background (will be referred to as "charge sand phenomenon" hereinafter) which is caused by, for example, a very small charging failure. Thus, images with better image qualities cannot be obtained.

To avoid this problem, one technical solution has been proposed. That is, in order to improve both the charging failure (typically known as "charge sand phenomenon" and also the lifetime reduction of the photosensitive member, such an AC current, or an AC voltage is applied by which no charge sand phenomenon may occur under the superior surface characteristic, for example, the initial stage of the charging member. Then, under such a condition that the surface characteristic is deteriorated after a preselected amount of charging members have been used, either the AC current or the AC voltage is sufficiently reduced to be applied by which no charge sand phenomenon may occur.

Also, another technical solution has been proposed. That is to say, under low humidity environment, the larger value of either an AC current or an AC voltage is applied as a bias to a charging member. Under normal humidity/high humidity environments, the smaller value of either an AC current or an AC voltage is applied as a bias to the charging member.

However, even when the above-proposed technical solutions are employed, there is still a certain possibility that an abnormal image is produced which is caused by the charging failure (typically known as "charge sand phenomenon"), because the use environments of the user are spread over wide range, the charging member is used under unwanted charging environments, and moreover, the surface characteristics of the charging members are fluctuated due to mass production. There is another problem. To prevent the occurrence of such an abnormal image within a very small number of users, when either the AC current or the AC voltage is further increased under normal use condition, the lifetime of the photosensitive member is considerably shortened, which is a problem.

In connection with this, one method capable of avoiding such a charge sand phenomenon may be conceived by executing a very simple process operation made by a judgement by either a user or a service man, while an output value is increased higher than the normally set output value. In this case, there is a certain possibility that a lifetime of a photosensitive member is reduced. Therefore, for example, when a charging member is exchanged, even if this newly exchanged charging member may own a superior uniform charging characteristic, this charging member is controlled by a large output value. As a consequence, the lifetime of this photosensitive member is unnecessarily reduced. In particular, in such a case that one person executes a process operation so as to avoid such a charge sand phenomenon, whereas the other person exchanges photosensitive member, the execution of this process operation cannot be reported to the last-mentioned person, so that the lifetime of the newly exchanged photosensitive member is unnecessarily shortened.

SUMMARY OF THE INVENTION

An object of the present invention is to provide such an image forming apparatus capable of obtaining a uniform charging characteristic over a long time period.

Another object of the present invention is to provide an image forming apparatus capable of adjusting a magnitude of an AC component which is applied to a charging member.

A further another object of the present invention is to provide an image forming apparatus comprising: an image bearing member; a charging member for contacting with the image bearing member and for charging the image bearing member, the charging member being provided within an exchangeable unit; applying means for applying an electric power containing an AC component to the charging member; adjusting means for adjusting a magnitude of the AC component applied by the applying means; and returning means for returning the magnitude of the AC component to an initial value thereof when the unit is exchanged.

Still further another object of the present invention may become apparent from the below-mentioned descriptions.

DESCRIPTION OF THE PREFERRED EMBODIMENTS

Referring now to drawings, various preferred embodiments of the present invention will be described.

Embodiment 1

Figure 1:
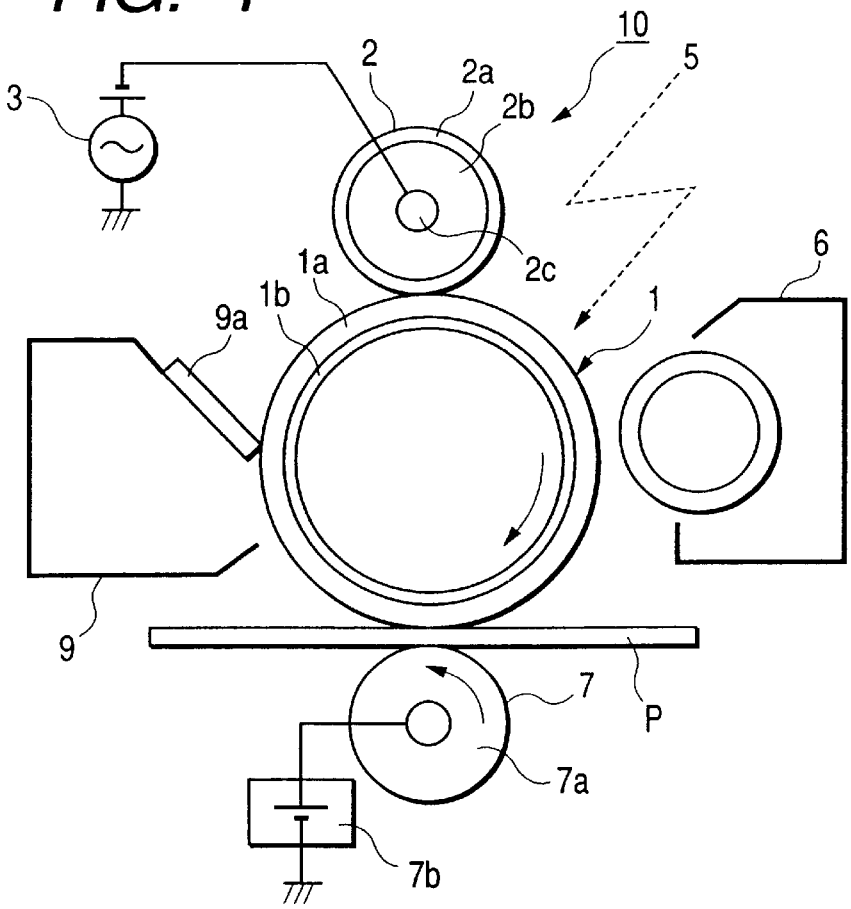
FIG. 1 is a schematic diagram showing an image forming apparatus according to the present invention.

FIG. 1 is a schematic diagram for illustrating the structure of an image forming apparatus according to Embodiment 1 of the present invention. That is, this image forming apparatus of the Embodiment 1 is a copying machine using the electrophotographic process.

In FIG. 1, reference numeral 1 denotes an image bearing member that is rotary-driven in a direction indicated by an arrow. This image bearing member 1 is a rotary drum type electrophotographic photosensitive member according to this Embodiment 1. This photosensitive member 1 is basically constituted by an electric conductive base layer 1*b* such as aluminum, and a photoconductive layer 1*a* formed on an outer surface of this electric conductive base layer 1*b*. It should be noted that the initial film thickness of the photoconductive layer 1*a* is 30 μm, and when the average film thickness thereof becomes thinner than, or equal to 10 μm, it is practically difficult to perform a uniform charging process.

Also, reference numeral 2 denotes a roller type charging member (will be referred to as "charging roller" hereinafter). This charging roller 2 is constituted by a center core metal 2*c*, an electric conductive layer 2*b* formed on an outer peripheral portion of this core metal 2*c*, and furthermore, a resistive layer 2*a* formed on an outer peripheral portion of this electric conductive layer 2*b*.

Then, the charging roller 2 is positioned in parallel to the drum type photosensitive member 1, while both end portions of the core metal 2*c* are rotatably supported by a bearing member (not shown). This charging roller 2 is pressurized, or depressed with respect to the photosensitive member 1 at a preselected pressure force by employing a depressing means (not shown). The charging roller 2 is rotated in the follower manner in conjunction with the rotating drive of the photosensitive member 1.

Also, reference numeral 3 denotes a bias applying power supply provided on a main body of the image forming apparatus, for applying a bias voltage with respect to the charging roller 2. The outer peripheral surface of the photosensitive member 1 is charging-processed by this charging roller 2 functioning as such a charging member to which the bias voltage is applied. This bias voltage is produced by superimposing a DC voltage on an AC voltage by the above-described bias applying power supply 3.

However, when the charging-processed surface of the photosensitive member 1 is exposed by using an exposed means 5 to subject image information (for example, laser scanning exposure and slit exposure of original image, and in this Embodiment 1, laser scanning exposure being conducted), an electrostatic latent image corresponding to the subject image information is formed on the charging-processed surface of the original image. The toner is adhered onto this electrostatic latent image by a develop apparatus 6, and then, the electrostatic latent images are sequentially visualized as toner images.

While an AC component is superimposed to a DC component and when the superimposed component is applied to the develop apparatus 6, this develop apparatus 6 is separated from the photosensitive member 1 by a distance of 0.3 mm, so that the jumping phenomenon may occur. It should be understood that negative toner has been employed as the toner.

The above-described toner image formed on the photosensitive member 1 is transferred to a transfer material "P" by using a transfer apparatus 7. The transfer apparatus 7 is equipped with a rotatable transfer roller 7*a* and a power supply 7*b*. The toner images formed on the photosensitive drum 1 are sequentially transferred to the upper surface of the transfer material P by applying electric charges having opposite (reverse) polarities to that of the toner from the rear surface side of this transfer material P by the power supply 7*b*. In this case, the transfer material P is transported, or conveyed from a convey apparatus (not shown) to a transfer unit provided between the photosensitive member 1 and the transfer apparatus 7 at proper timing in synchronism with the rotation of the photosensitive member 1.

After the transfer material P to which the toner image has been transferred is separated from the photosensitive member 1, this transfer material P is conveyed to a fixing apparatus (not shown) so as to fix thereon the toner image. Subsequently, this transfer material P on which the toner image has been fixed is discharged outside of the main body of the image forming apparatus. In this case, when another image is formed also on the rear surface of this transfer material P, this transfer material P is conveyed to a reconveying means to the transfer unit.

The toner remained on the photosensitive member 1 from which the toner image has been transferred is scraped off by a cleaning blade 9*a* of a cleaning apparatus 9 so as to be cleared. Then, this photosensitive member 1 is subjected to removing charge by exposure to be initialized so as to prepare the next image forming operation.

Alternatively, while gears may be mounted on the contact charging type charging roller 2 and the transfer roller 7*a*, both the contact charging type charging roller 2 and the transfer roller 7*a* may be forcibly driven by a drive means such as a motor.

Figure 2:
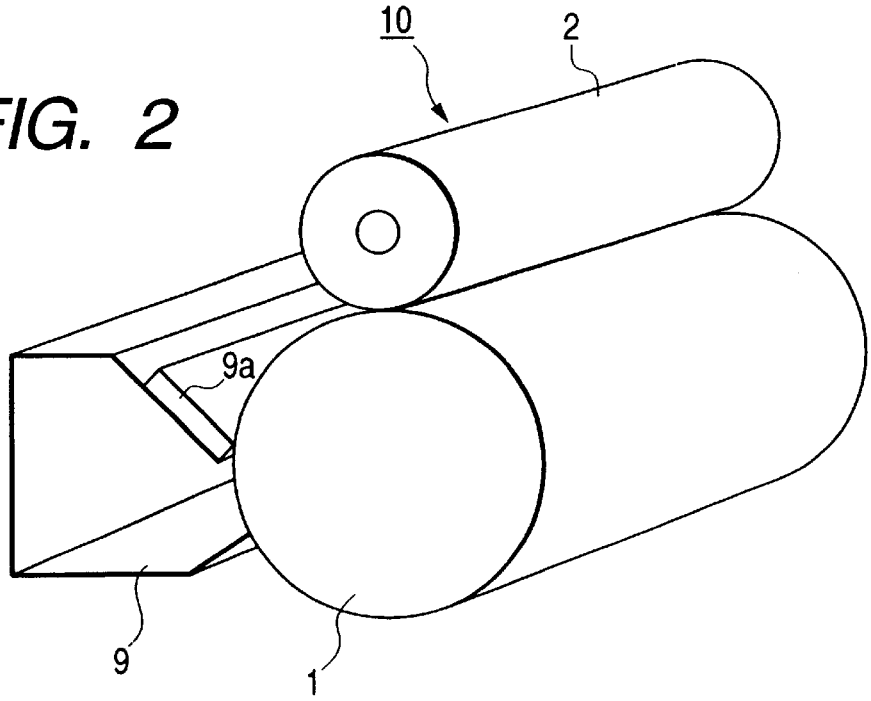
FIG. 2 is a perspective view showing an integral type unit of the image forming apparatus according to the present invention.

On the other hand, as shown in FIG. 2, such an integral type unit 10 assembled with the photosensitive material 1, the charging roller 2, and the cleaning apparatus 9 is provided in the image forming apparatus according to this Embodiment 1.

Then, when the above-explained integral type unit 10 is mounted on the main body of the image forming apparatus, a bias is applied from a power supply terminal employed inside the main body of the image forming apparatus to the charging roller 2. Under normal operation of this image forming apparatus, this bias is applied under such a condition that the DC constant voltage is set to −750 V, the AC constant current is set to 2100 μA, and the frequency is set to 1800 Hz, and also the sine wave is employed as the bias waveform.

In the case that this image forming apparatus was operated to form the image by employing 100 sets of the integral type units 10 under environments having temperature of 25° C. and relative humidity of 5%, a so-called "charge sand phenomenon (sand phenomenon)" appeared in the image forming initial stages in 3 sets of these integral type units 10 among 100 sets. Therefore, a button (not shown) provided on the main body of this image forming apparatus was depressed in order to switch the present bias mode to a higher bias mode (the high side bias mode).

Figure 3:
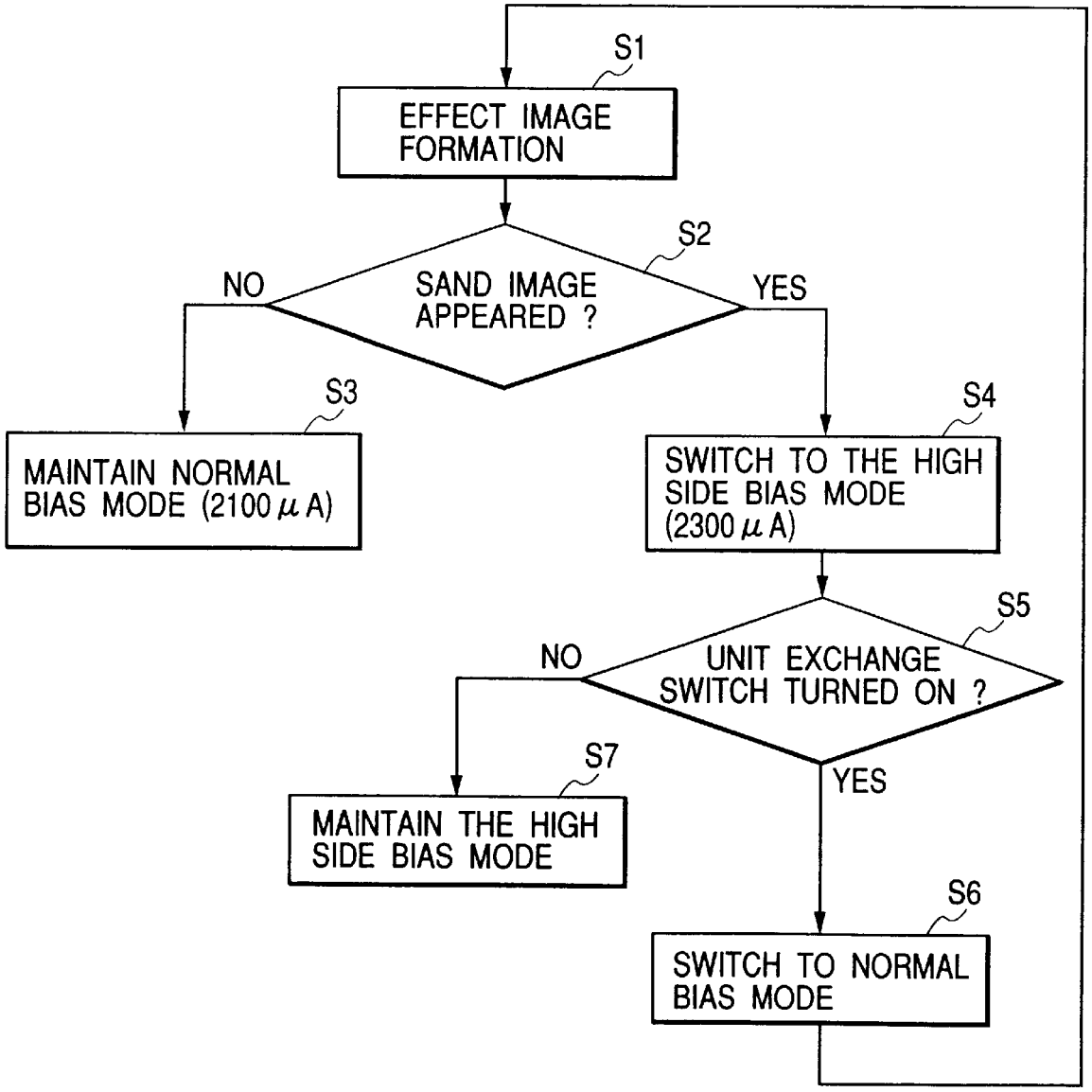
FIG. 3 is a flow chart describing a bias mode switching process operation of the image forming apparatus in accordance with Embodiment 1 of the present invention.

Referring now to a flow chart shown in FIG. 3, a description will be made of a bias mode switching sequential operation executed in the image forming apparatus of the Embodiment 1.

When an image forming operation is carried out (step Si) in this first image forming apparatus, a CPU (not shown) employed in this image forming apparatus judges as to whether or not the sand image" is appeared and also the button is depressed (step S2). When this button is not depressed, the image forming operation is continued with keeping the normal bias mode, namely the AC constant current being selected to be 2100 μA (step S3).

To the contrary, when the sand image is produced and the button is depressed, the present bias mode is switched to the higher bias mode (step S4). In this higher bias mode, the bias is outputted under AC constant current of 2300 μA. Note that both the DC constant voltage value and the frequency are not changed.

As a result of investigation made by the Inventors, since this higher bias mode is switched, the charge sand phenomenon which appears in the initial stage of the image forming operation could appear. Also, while 60,000 sheets (average value) of images are formed in passing of A4 sized paper in lateral direction under normal bias mode, 40,000 sheets (average value) of images could be formed by each of 3 sets of the integral type units 10.

In the image forming apparatus according to this Embodiment 1, when the integral type unit 10 is exchanged, the CPU checks as to whether or not either the user or the service man depresses a unit exchange switch (not shown) (step S5). When this unit exchange switch is depressed, the CPU switches the present higher bias mode to the normal bias mode (step S6). Thus, the bias applied to the charging roller 2 is returned to the AC constant current of 2100 μA during the normal image forming operation as to the subsequent image forming operation. To the contrary, when the unit exchange switch is not depressed, the image forming operation is continued while maintaining this higher bias mode (step S7).

It should also be noted that although the AC constant current value in the higher bias mode is set to 2300 μA in the above-described Embodiment 1, the present invention is not limited thereto. Alternatively, if no charge sand phenomenon occurs, than any AC constant current values may be used. Also, in this Embodiment 1, the AC constant current control operation is carried out when the image is formed. Also, this inventive idea may be similarly applied to such a case that the image is formed under AC constant voltage control operation.

As previously explained, in accordance with this Embodiment 1, the occurrence of the charge sand image can be simply prevented by merely depressing the button. Also, when the integral type unit 10 is exchanged, the image forming operation under normal output value can be simply returned from the higher bias mode by depressing the button (not shown) by, for example, the user and the service man.

Accordingly, in such an integral type unit 10 which has been exchanged to be newly mounted, the normal total number of images can be obtained, so that short lifetime of the integral type unit can be avoided.

Furthermore, in the above-explained Embodiment 1, such an integral type unit 10 constituted by assembling the photosensitive member 1, the charging roller 2, and the cleaning apparatus 9 is employed, but the present invention is not limited thereto. For instance, when a charging roller is exchangeable, it is alternatively possible to conceive such a system that when such a charging roller is exchanged, the higher bias output value is automatically returned to the normal output value by merely depressing the button.

Embodiment 2

Next, an image forming apparatus, according to Embodiment 2 of the present invention, will now be described.

In the present Embodiment, the image forming apparatus is provided with a detecting means for detecting a value of a current flowing through the photosensitive member 1, while applying a DC constant voltage of −750 V to the charging roller 2 (will be referred to as an "APVC detecting" hereinafter). This APVC detecting is employed so as to sense a thickness of an insulating layer 1*a* of the photosensitive member 1.

In the case that the integral type unit 10 formed by assembling the photosensitive member 1, the charging roller 2, and the cleaning apparatus 9 is employed, a total image forming number of the photosensitive member 1 is equal to that of the charging roller 2. The thickness of the insulating layer 1*a* is roughly calculated based upon the data acquired by the APVC detecting. Then, a total image forming number of the charging roller 2 may be roughly grasped in correspondence with a total image forming number of the photosensitive member 1 based upon the relative relationship with this total image forming number.

Therefore, in the present Embodiment, such an image forming operation is carried out in correspondence with the thickness of the insulating layer 1*a* of the photosensitive member 1 based on the data acquired from the APVC detecting.

In accordance with this Embodiment 2, when the exchange of the integral type unit 10 is prospected, such a system capable of automatically executing the APVC detecting is employed. This APVC detecting is automatically performed in conjunction with various operations, for example, when the switch of the main power source is turned ON, when the exterior doors of the main body of this image forming apparatus are opened/closed, or in response to a signal issued from a unit setting/releasing sensing means (not shown).

When the integral type unit 10 available before image forming operation is employed, the sense current value by the APVC detecting is approximately 10 to 15 $\mu$A, whereas when the integral type unit 10 available at an end stage of this image forming operation is employed, the sense current value by the APVC detecting is approximately 50 $\mu$A.

As a consequence, in accordance with this embodiment mode, such a judgement is made that an old integral type unit 10 is exchanged by a new integral type unit 10 when the sensing current value becomes larger than the preceding APVC detecting data value by 10 $\mu$A. As a result, the bias applied to the charging roller 2 for forming the image after the APVC detecting is returned to the AC constant current of 2100 $\mu$A under normal use condition.

Figure 4:
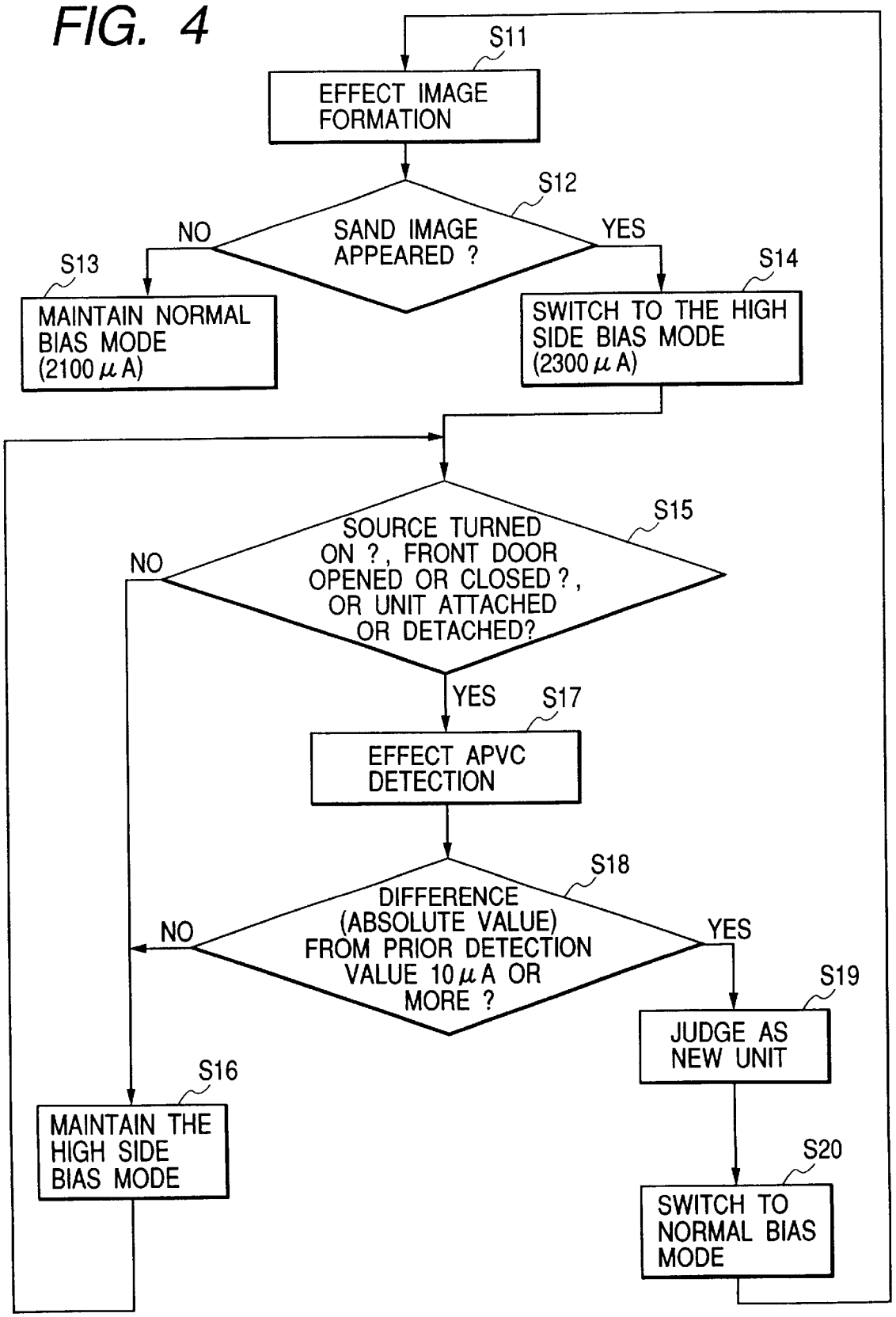
FIG. 4 is a flow chart for describing a bias mode switching process operation of the image forming apparatus in accordance with Embodiment 2 of the present invention.

Referring now to a flow chart shown in FIG. 4, a description will be made of a bias mode switching sequential operation.

When an image forming operation is carried out (step S11) in this second image forming apparatus, it is judged whether or not a so-called "charge sand image" is produced and also the button is depressed (step S12). When this button is not depressed, the image forming operation is continued with keeping the normal bias mode, namely the AC constant current being selected to be 2100 $\mu$A (step S13).

To the contrary, when the charge sand image is produced and the button is depressed, the present bias mode is switched to the higher bias mode (step S14). In this higher bias mode, the bias is outputted under AC constant current of 2300$\mu$A. Note that both the DC constant voltage value and the frequency are not changed.

Then, in the image forming apparatus according to this Embodiment 2, the judgement as to whether or not the exchange of the integral type unit 10 is suspected is made based upon such a condition that the main power switch is turned ON, the front door of the exterior of the main body is opened/closed, or the ON signal of the unit setting/releasing sensing means or the like (step S15). When the exchange of the integral type unit 10 is not suspected, the image forming operation is continued while maintaining the higher bias mode (step S16).

To the contrary, when the exchange of the integral type unit 10 is suspected, the CPU automatically executes the APVC detecting in connection with such a condition that the main power switch is turned ON, the front door of the exterior of the main body is opened/closed, or the ON signal is issued from the unit setting/releasing sensing means (step S17). The CPU judges as to whether or not a difference value (absolute value) between the present APVC detecting data value and the preceding APVC detecting data is higher than, or equal to 10 $\mu$A (step S18). In the case that this difference value (absolute value) is higher than, or equal to 10 $\mu$A, the CPU judges that the presently used integral type unit 10 is exchanged by a new integral type unit (step S19). As a result, the bias applied to the charging roller 2 so as to form the image after the APVC detecting is returned to the AC constant current of 2100 $\mu$A during the normal use mode (step S20). To the contrary, when the difference value (absolute value) is smaller than 10 $\mu$A, the image forming operation is continued while maintaining the higher bias mode (step S16).

As previously described, in accordance with this Embodiment 2, after the image forming apparatus is used in the higher bias mode, when the integral type unit 10 is set/released, this image forming apparatus automatically judges as to whether or not the integral type unit 10 is set/released without requiring the extra operation. As a consequence, it can be effected easily to be returned to the normal bias output value. Moreover, for example, even when the integral type unit 10 which has been once released for the exchange purpose is mistakenly loaded by the user, or the service man, this image forming apparatus can continue the image forming operation in the higher bias mode without erroneous confirmation, and therefore can avoid reproducing of the charge sand image.

Also, the image forming apparatus can be properly operated, while accepting such a case that one person sets the higher bias mode, but another person exchanges the integral type unit 10, and the information indicative of such a fact that the normal bias mode is switched to the higher bias mode is not reported to the last-mentioned person.

It should also be noted that in this embodiment mode, it is so judged that the presently used integral type unit 10 is exchanged by the new integral type unit when the present APVC detecting data value becomes higher than, or equal to 10 $\mu$A with respect to the preceding APVC detecting data value, but the present invention is not limited thereto. Alternatively, this APVC detecting data value may be substituted by other proper data value capable of judging the exchange of such an integral type unit.

Also, in such a case that there is a rule to depress the switch (not shown) when the integral type switch is exchanged, if this switch is depressed, then the CPU automatically may judge that the present integral type unit has been exchanged by the new integral type unit irrespective of the APVC detecting data value, and the higher bias output value is returned to the normal output value.

Moreover, since the image forming apparatus according to the present embodiment employs the DC constant voltage output control means, for instance, detecting of the DC voltage value when the DC constant current is applied to the charging roller 2, the AC current value when the AC constant voltage is applied thereto, and the AC voltage value when the AC constant current is applied thereto can be used, instead of detecting the DC current value when the DC constant voltage is applied to the charging roller 2.

While the image forming apparatus according to the present invention has been described with reference to the embodiments, the present invention is not limited thereto and may be modified without departing from the technical scope and spirit of the present invention.

What is claimed is:

1. An image forming apparatus comprising:

an image bearing member;

a charging member for contactably charging said image bearing member, said charging member being provided within an exchangeable unit;

applying means for applying an electric power containing an AC component to said charging member;

adjusting means for increasing a magnitude of the AC component applied by said applying means on the basis of an input signal inputted by an operator or a service man; and returning means for returning the magnitude of the AC component to an initial value thereof when the exchangeable unit is exchanged.

2. An image forming apparatus according to claim 1, wherein said adjusting means increases the AC component on the basis of an input signal input by an operator or a service man.

3. An image forming apparatus according to claim 1, further comprising judging means for judging whether or not the exchangeable unit is exchanged on the basis of a current flowing from said charging member to said image bearing member.

4. An image forming apparatus according to claim 3, wherein said judging means judges whether or not the exchangeable unit is exchanged on the basis of a current flowing through said image bearing member when a DC constant voltage is applied to said charging member.

5. An image forming apparatus according to claim 1, wherein the exchangeable unit further includes said image bearing member.

6. An image forming apparatus comprising:

an image bearing member;

a charging member for contactably charging said image bearing member, said charging member being provided within an exchangeable unit;

an applying unit which applies an electric power containing an AC component to said charging member;

an adjusting unit for increasing a magnitude of the AC component applied by said applying unit on the basis of an input signal inputted by an operator or a service man; and a returning unit which returns the magnitude of the AC component to an initial value thereof when the exchangeable unit is exchanged.

7. An image forming apparatus according to claim 6, further comprising a judging unit which judges whether or not the exchangeable unit is exchanged on the basis of a current flowing from said charging member to said image bearing member.

8. An image forming apparatus according to claim 7, wherein said judging unit judges whether or not the exchangeable unit is exchanged on the basis of a current flowing through said image bearing member when a DC constant voltage is applied to said charging member.

9. An image forming apparatus according to claim 7, wherein said judging unit judges whether or not the exchangeable unit is exchanged on the basis of a current flowing through said image bearing member when an AC constant voltage is applied to said charging member.

10. An image forming apparatus according to claim 7, wherein the exchangeable unit further includes said image bearing member.

* * * * *

UNITED STATES PATENT AND TRADEMARK OFFICE

CERTIFICATE OF CORRECTION

PATENT NO. : 6,512,905 B1 
DATED : January 28, 2003
INVENTOR(S) : Satoshi Tomiki et al.

It is certified that error appears in the above-identified patent and that said Letters Patent is hereby corrected as shown below:

Column 5,
Line 46, "Si)" should read -- S1) --.

Column 9,
Lines 8 to 11, should be deleted.

Signed and Sealed this

Second Day of December, 2003

JAMES E. ROGAN
*Director of the United States Patent and Trademark Office*